US006050807A

United States Patent [19]

Baek

[11] Patent Number: 6,050,807

[45] Date of Patent: Apr. 18, 2000

[54] METHOD AND APPARATUS FOR CONTROLLING AN AMOUNT OF AIR OF A GAS BOILER

[75] Inventor: Sung-Hak Baek, Seoul, Rep. of Korea

[73] Assignee: Daewoo Electronics Co. Ltd., Seoul, Rep. of Korea

[21] Appl. No.: 09/156,295

[22] Filed: Sep. 18, 1998

[30] Foreign Application Priority Data

Dec. 24, 1997 [KR] Rep. of Korea ..... 97-73406

[51] Int. Cl.[7] ..... F23N 11/44

[52] U.S. Cl. ..... 431/12; 431/90; 431/75; 431/24; 122/DIG. 7

[58] Field of Search ..... 431/12, 18, 89, 431/90, 20, 29, 75, 24, 25; 126/116 R, 116 A, 110 R, 110 A; 122/DIG. 7

[56] References Cited

U.S. PATENT DOCUMENTS

| | | | |
|---|---|---|---|
| 3,292,855 | 12/1966 | Wright | 431/12 |
| 3,990,433 | 11/1976 | Keating | 431/351 |
| 4,913,128 | 4/1990 | Adachi | 431/12 |
| 4,927,351 | 5/1990 | Hagar et al. | 431/90 |
| 5,882,185 | 3/1999 | Kim | 431/20 |

FOREIGN PATENT DOCUMENTS

| | | | |
|---|---|---|---|
| 1-302027 | 12/1989 | Japan | 431/18 |
| 2-146412 | 6/1990 | Japan | 431/18 |

*Primary Examiner*—Ira S. Lazarus
*Assistant Examiner*—Josiah C. Cocks
*Attorney, Agent, or Firm*—Pillsbury Madison & Sutro LLP

[57] ABSTRACT

A method and an apparatus for controlling an amount of air of a gas boiler are disclosed. Detecting section detects a flame voltage of the gas boiler to output a flame voltage value signal which represents a flame voltage value. An air supplying fan supplies air into the gas boiler. A sensing section senses a rotative velocity of the air supplying fan to output a sensing signal which represents a present rotative velocity of the air supplying fan. A control section reads out a minimum rotative velocity of the air supplying fan, which is required for preventing a yellow flame, corresponding to a presently-supplied gas amount which is supplied to the gas boiler, receives the sensing signal which represents a present rotative velocity of the air supplying fan from the sensing section, receives the flame voltage value signal which represents the flame voltage value from the detecting section, controls the rotative velocity of the air supplying fan by comparing the flame voltage value with a predetermined reference flame voltage value, and controls the rotative velocity of the air supplying fan by comparing the present rotative velocity of the air supplying fan with the minimum rotative velocity. As a result, the lifting and the yellow flame which are generated from the flame of the gas boiler may be prevented. Also, the loss of the heating power of the gas boiler may be prevented.

2 Claims, 2 Drawing Sheets

METHOD AND APPARATUS FOR CONTROLLING AN AMOUNT OF AIR OF A GAS BOILER

BACKGROUND OF THE INVENTION

1. Field of the Invention

The present invention relates to a gas boiler, and more particularly to a method and an apparatus for controlling an amount of air of a gas boiler which can prevent a lifting and a yellow flame of a flame.

2. Description of the Prior Art

In general, a gas boiler which uses a gas as fuel heats water using a high temperature energy generated by burning the gas. The heated water circulates through heating pipes which are provided at a room and emits heat to the room. The gas which is used as fuel of the gas boiler is burned almost completely. Consequently, due to the absence of environmental pollution, the gas boiler is gradually and widely used due to its convenience of use.

However, if a favorable wind flows into the burner of the gas boiler from the outside of the gas boiler while the gas boiler is being operated, a lifting of a flame from the burner is occurred. As a result, since the flame of the gas boiler is not stabilized and a heating power becomes weak, a heating efficiency of the gas boiler is decreased.

Currently, in order to solve the above described lifting phenomena of the flame, a method for controlling a rotative velocity of an air supplying fan which supplies an external air to the burner of the gas boiler is being provided.

However, if the rotative velocity of the air supplying fan is decreased below the minimum rotative velocity of the air supplying fan in order to solve the lifting of the flame, an amount of air which is supplied to the burner of the gas boiler is insufficient. As a result, a yellow flame is generated because the gas which is supplied to the burner is not burned completely.

SUMMARY OF THE INVENTION

Therefore, it is an object of the present invention to provide a method for controlling an amount of air of a gas boiler which can prevent a lifting and a yellow flame which are generated by a favorable wind from the outside while the gas boiler is being operated.

It is another object of the present invention to provide an apparatus for controlling an amount of air of a gas boiler which can prevent a lifting and a yellow flame of a flame of the gas boiler In order to achieve the above objects, the present invention provides a method for controlling an amount of air of a gas boiler, which comprises the steps of:

(i) monitoring a lifting occurrence of a flame by using a flame voltage value signal obtained from the flame;

(ii) reading out a minimum rotative velocity of an air supplying fan, for preventing a yellow flame occurrence, corresponding to a presently-supplied gas amount when the lifting occurrence of the flame is monitored in step (i);

(iii) comparing a present rotative velocity of said air supplying fan with the minimum rotative velocity; and (iv) decreasing the present rotative velocity of said air supplying fan when in step (iii) the present rotative velocity of said air supplying fan is higher than the minimum rotative velocity, to remove the lifting occurrence.

In order to achieve the above objects, the present invention provides an apparatus for controlling an amount of air of a gas boiler, which comprises:

detecting means for detecting a flame voltage of said gas boiler to output a flame voltage value signal;

an air supplying fan for supplying air into said gas boiler;

sensing means for sensing a rotative velocity of said air supplying fan to output a sensing signal; and control means for reading out a minimum rotative velocity of said air supplying fan, for preventing a yellow flame, corresponding to a presently-supplied gas amount supplied into said gas boiler, for receiving the sensing signal which represents a present rotative velocity of said air supplying fan from said sensing means, for receiving the flame voltage value signal which represents a flame voltage value from said detecting means, for controlling the present rotative velocity of said air supplying fan by comparing the flame voltage value with a reference flame voltage value, and for controlling the present rotative velocity of said air supplying fan by comparing the present rotative velocity with the minimum rotative velocity of said air supplying fan.

In the method and apparatus for controlling an amount of air of a gas boiler according to the present invention, the rotative velocity of the air supplying fan is decreased until not only the lifting but also the yellow flame are not generated. As a result, the lifting and the yellow flame which are generated from the flame of the gas boiler may be prevented. Also, the loss of the heating power of the gas boiler may be prevented.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A description will be given below in detail with reference to the accompanying drawings to a configuration and an operation of a method and an apparatus for controlling an amount of air of a gas boiler according to an embodiment of the present invention.

Figure 1:
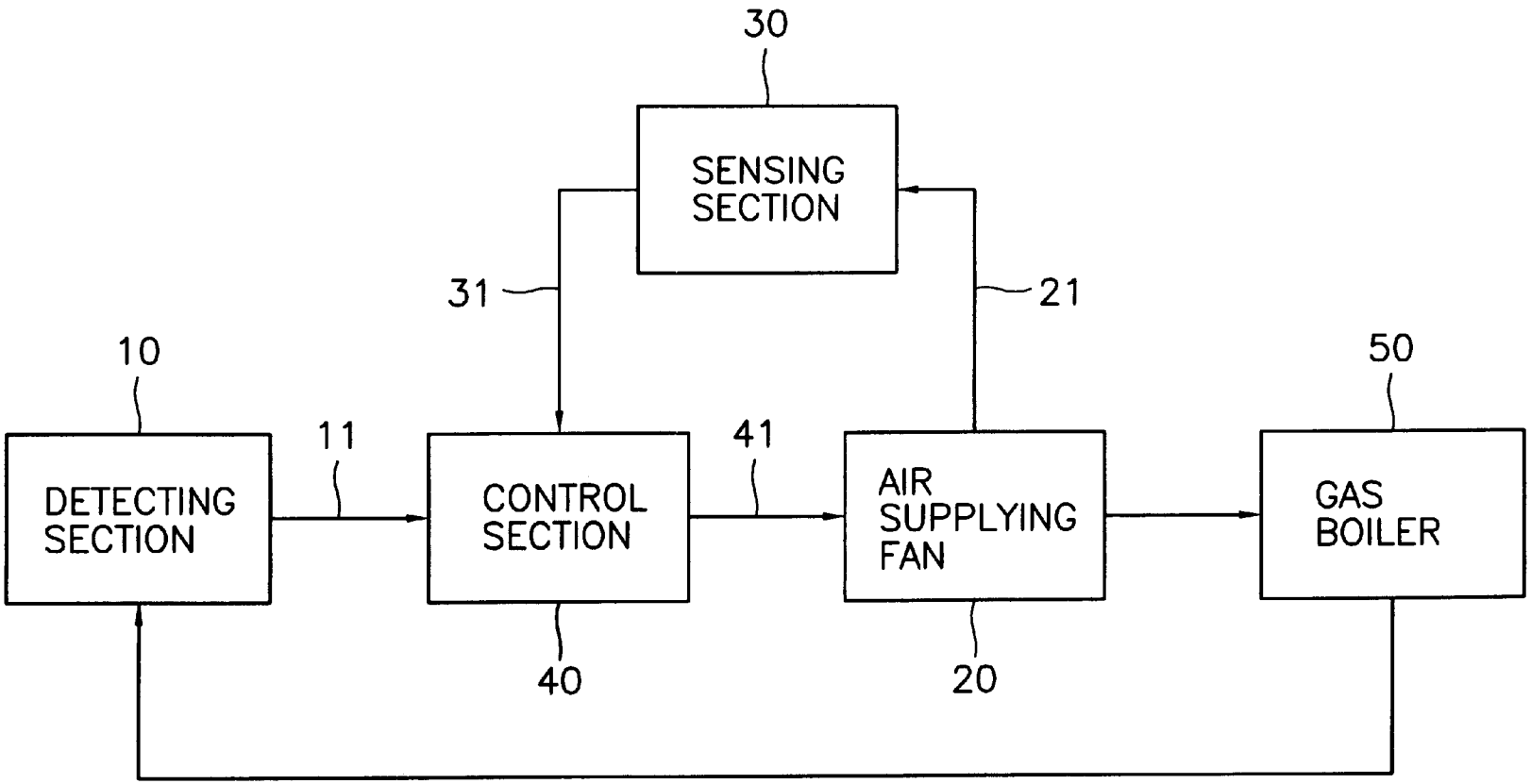
FIG. 1 is a block diagram for showing a circuit configuration of an apparatus for controlling an amount of air of a gas boiler according to an embodiment of the present invention.

FIG. 1 is a block diagram for showing a circuit configuration of an apparatus for controlling an amount of air of a gas boiler according to an embodiment of the present invention. As shown in FIG. 1, the apparatus for controlling an amount of air of a gas boiler has a detection section 10, an air supplying fan 20, a sensing section 30, and a control section 40. Detecting section 10 is an infrared sensor, and control section 40 is a microcomputer.

Detecting section 10 detects a wave length of a flame of the gas boiler by using the infrared sensor. Also, detecting section 10 converts the detected wave length into a flame voltage value and provides a flame voltage value signal 11 which represents the converted flame voltage value to control section 40.

Air supplying fan 20 supplies air to a burner of the gas boiler. In addition, a rotative velocity of air supplying fan 20 is either decreased or increased in accordance with a control signal 41 from control section 40.

Sensing section 30 senses the rotative velocity of air supplying fan 20 and provides a sensing signal 31 which represents the sensed rotative velocity to control section 40.

Control section 40 receives the flame voltage value signal 11 which represents the flame voltage value of the flame from detecting section 10 and receives the sensing signal 31 which represents the rotative velocity of the air supplying fan 20 from sensing section 30, respectively.

Control section 40 checks whether or not the flame of the burner is being lifted based on flame voltage value signal 11 from detecting section 10.

That is, control section 40 compares the flame voltage value which is represented by flame voltage value signal 11 with a predetermined reference flame voltage value stored in the memory field of the microcomputer which is used as control section 40 while the gas boiler is being operated.

The flame voltage value which is represented by flame voltage value signal 11 from detecting section 10 is higher than the predetermined reference flame voltage value while the flame of the burner is being lifted. Accordingly, control section 40 applies control signal 41 to air supplying fan 20 to decrease the rotative velocity of air supplying fan 20.

Also, control section 40 reads out a minimum rotative velocity of air supplying fan 20, which is required for preventing the yellow flame, corresponding to a presently-supplied gas amount which is supplied to the gas boiler from the memory field thereof. Control section 40 compares the minimum rotative velocity with the present rotative velocity of air supplying fan 20 which is represented by sensing signal 31 from sensing section 30, and controls air supplying fan 20 based on the compared result either to decrease or to maintain the present rotative velocity of air supplying fan 20.

At this time, the minimum rotative velocity of air supplying fan 20 corresponding to the presently-supplied gas boiler which is supplied to the gas boiler is stored in a memory field of the microcomputer. Also, the minimum rotative velocity of air supplying fan 20 is a rotative velocity for maintaining a combustion status at which a yellow flame from the gas boiler is not generated.

Hereinafter, the method for controlling an amount of air of a gas boiler which is performed by the apparatus shown in FIG. 1, will be described with reference to the flowchart of FIG. 2.

Figure 2:
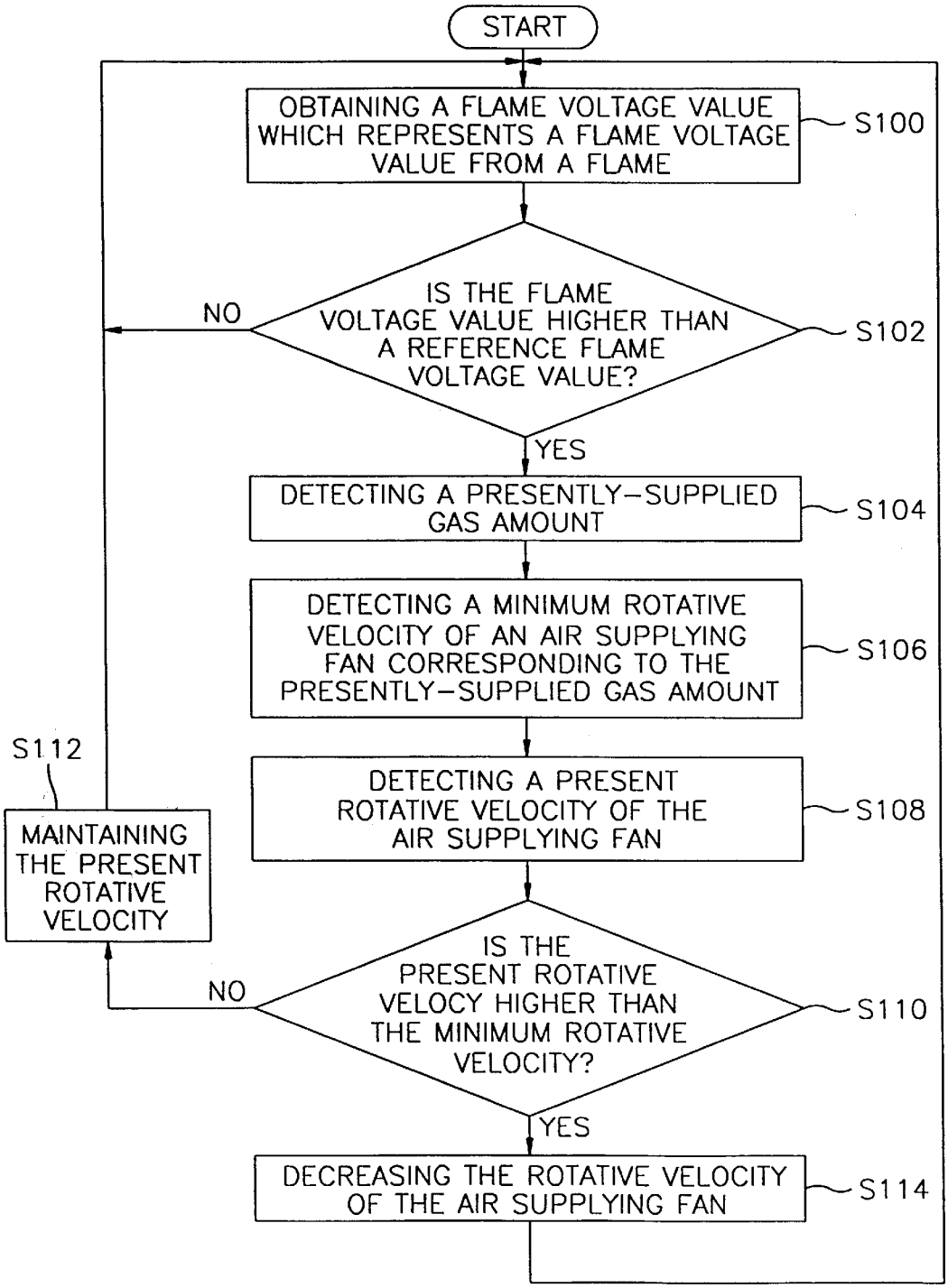
FIG. 2 is a flowchart for illustrating a method for controlling an amount of air of a gas boiler by using the apparatus shown in FIG. 1.

FIG. 2 is a flowchart for illustrating a method for controlling an amount of air of a gas boiler by using the apparatus shown in FIG. 1.

As shown in FIG. 2, detecting section 10 detects a wave length of the flame of the gas boiler, and converts the detected wave length into a flame voltage value in order to output flame voltage value signal 11.

Control section 40 receives flame voltage value signal 11 of the gas boiler from detecting section 10 (step S100). Flame voltage value signal 11 which represents the flame voltage value of the flame from detecting section 10 is a signal for checking whether or not the lifting of the flame is being occurred. That is, when the flame voltage value of the flame which is represented by flame voltage value signal 11 is higher than the predetermined reference flame voltage value, the lifting of the flame is occurred. On the other hand, when the flame voltage value of the flame which is represented by flame voltage value signal 11 is not higher than the predetermined reference flame voltage value, the lifting of the flame is not occurred. In this manner, a lifting occurrence of a flame is monitored by using flame voltage value signal 11 outputted from detecting section 10.

Control section 40 compares the flame voltage value which is represented by flame voltage value signal 11 with the predetermined reference flame voltage value to check whether or not the flame voltage value which is inputted from detecting section 10 is higher than the predetermined reference flame voltage value (step S102).

When it is checked in step S102 that the flame voltage value by flame voltage value signal 11 which is inputted from detecting section 10 is not higher than the predetermined reference flame voltage value, control section 40 returns to step S100 since the flame of the gas boiler is in a normal combustion status (step S102).

When it is checked in step S102 that flame voltage value by flame voltage value signal 11 which is inputted from detecting section 10 is higher than the predetermined reference flame voltage value, control section 40 detects the presently-supplied gas amount which is being supplied to the burner of the gas boiler (step S104).

In step S106, control section 40 reads out the minimum rotative velocity of air supplying fan 20, which is required for preventing the yellow flame, corresponding to the presently-supplied gas boiler which is detected in step S104.

Also, control section 40 receives sensing signal 31 which represents a present rotative velocity of air supplying fan 20 from sensing section 30 (step S108).

Control section 40 compares the present rotative velocity of air supplying fan 20 which is received in step S108 with the minimum rotative velocity of air supplying fan 20 which is read in step S106 to check whether or not the present rotative velocity is higher than the minimum rotative velocity (step S110).

When it is checked in step S110 that the present rotative velocity which is received in step S108 is not higher than the minimum rotative velocity which is read in step S106, control section 40 controls air supplying fan 20 to maintain the present rotative velocity of air supplying fan 20 (step S112).

Because the minimum rotative velocity of air supplying fan 20 is the minimum rotative velocity to supply the burner with the smallest amount of air which is needed for the presently-supplied gas amount supplied to the burner.

Namely, if the present rotative velocity of air supplying fan 20 is lower than the minimum rotative velocity, the air amount which is supplied to the burner is insufficient.

Accordingly, the gas which is supplied to the burner of the gas boiler is not burned perfectly, and the yellow flame is generated.

In step S110, when it is checked that the present rotative velocity which is received in step S108 is higher than the minimum rotative velocity which is read in step S106, control section 40 controls air supplying fan 20 to decrease the present rotative velocity of air supplying fan 20 (step S114).

In the method and apparatus for controlling an amount of air of a gas boiler according to the present invention, the rotative velocity of the air supplying fan is decreased until not only the lifting of the flame but also the yellow flame are not generated. As a result, the lifting and the yellow flame which are generated from the flame of the gas boiler may be prevented. Also, the loss of the heating power of the gas boiler may be prevented.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A method for controlling an amount of air of a gas boiler, said method comprising the steps of:

monitoring a lifting occurrence of a flame by detecting a wave length of a flame from the gas boiler, by converting the detected wave length into a flame voltage signal of which value corresponds to the wave length and by comparing the value of the flame voltage signal with a reference flame voltage value;

reading out a minimum rotative velocity of an air supplying fan for preventing a yellow flame occurrence, wherein the minimum rotative velocity corresponds to a presently-supplied gas amount when the lifting occurrence of the flame is monitored;

detecting a present rotative velocity of the air supplying fan;

comparing the present rotative velocity with the minimum rotative velocity; and decreasing the present rotative velocity of the air supplying fan when the present rotative velocity is higher than the minimum rotative velocity to remove the lifting occurrence, otherwise maintaining the present rotative velocity of the air supplying fan.

2. An apparatus for controlling an amount of air of a gas boiler, said apparatus comprising:

detecting means for detecting a wave length of a flame from the gas boiler, and for converting the detected wave length into a flame voltage signal of which value corresponds to the wave length;

an air supplying means for supplying air into said gas boiler;

sensing means for sensing a rotative velocity of said air supplying means to output a sensing signal; and control means for comparing the value of the flame voltage signal from the detecting means with a reference flame voltage to monitor a lifting occurrence of a flame, for reading out a minimum rotative velocity of said air supplying means for preventing a yellow flame occurrence, corresponding to a presently-supplied gas amount supplied into said gas boiler, which for comparing the rotative velocity from the sensing means with the minimum rotative velocity, and controlling the air supplying means so as to decrease the rotative velocity of the air supplying means when the rotative velocity is higher than the minimum rotative velocity, otherwise to maintain the rotative velocity.

* * * * *